US011260438B2

(12) United States Patent
Cho

(10) Patent No.: US 11,260,438 B2
(45) Date of Patent: Mar. 1, 2022

(54) WIRE ROD ROLLING ROLLER AND GAP ADJUSTMENT DEVICE THEREOF

(71) Applicant: ANDONG NATIONAL UNIVERSITY INDUSTRY-ACADEMIC COOPERATION FOUNDATION, Andong-si (KR)

(72) Inventor: Hee Keun Cho, Andong-si (KR)

(73) Assignee: Andong National University Industry-Academic Cooperation Foundation, Andong-si (KR)

( * ) Notice: Subject to any disclaimer, the term of this patent is extended or adjusted under 35 U.S.C. 154(b) by 90 days.

(21) Appl. No.: 16/796,647

(22) Filed: Feb. 20, 2020

(65) Prior Publication Data

US 2020/0331044 A1 Oct. 22, 2020

(30) Foreign Application Priority Data

Apr. 18, 2019 (KR) ..... 10-2019-0045463
Apr. 18, 2019 (KR) ..... 10-2019-0045464

(51) Int. Cl.
*B21B 1/16* (2006.01)

(52) U.S. Cl.
CPC ..... *B21B 1/16* (2013.01)

(58) Field of Classification Search
CPC ..... B21B 1/16; B21B 1/163; B21B 39/00; B21B 35/14; B21B 37/58; B21B 37/60;
(Continued)

(56) References Cited

U.S. PATENT DOCUMENTS 1,723,928 A * 8/1929 Fisher ..... B21B 31/076 384/317
1,727,843 A * 9/1929 Tilley ..... F26B 17/286 159/11.1

(Continued)

FOREIGN PATENT DOCUMENTS

CN 108284131 A * 7/2018
JP 63278604 A * 11/1988 ..... B21B 28/04

(Continued)

OTHER PUBLICATIONS

Office Action of Korean Patent Application No. 10-2019-0045463—5 pages (dated Jul. 13, 2020).

(Continued)

*Primary Examiner* — Teresa M Ekiert
*Assistant Examiner* — Sarkis A Aktavoukian
(74) *Attorney, Agent, or Firm* — Knobbe Martens Olson & Bear LLP

(57) ABSTRACT

A wire rod rolling roller is disclosed. In one aspect, the wire rod rolling roller includes upper and lower rollers spaced apart from each other and configured to roll a wire rod passing therebetween and upper and lower drive shafts fixedly extending through the centers of the upper and lower rollers, respectively, and configured to rotate the upper and lower rollers. The wire rod rolling roller also includes upper and lower bearing housings respectively disposed on one side of the upper drive shaft and one side of the lower drive shaft, and configured to support the upper and lower drive shafts. The wire rod rolling roller further includes a journal bearing inserted into the upper and lower bearing housings and in surface contact with the upper and lower drive shafts to minimize fiction and a gap adjustment device configured to adjust a gap between the upper and lower rollers.

8 Claims, 6 Drawing Sheets

(58) Field of Classification Search
CPC ..... B21B 37/64; B21B 31/24; B21B 31/20; B21B 31/16; B21B 45/0269; B21B 45/0272; B21B 45/0275; B21B 2271/02; B21B 38/10; B21B 38/105; B21B 2271/025; B08B 1/005; B08B 1/008; B08B 1/02; B65G 45/12; B65G 45/10; B65G 45/20
USPC ..... 15/256.5, 256.51, 256.53; 72/40, 236, 72/240, 248
See application file for complete search history.

(56) References Cited

U.S. PATENT DOCUMENTS 2,353,290 A * 7/1944 Bennewitz ..... B21B 1/16 72/242.2
2,549,718 A * 4/1951 Spang ..... B27B 13/16 15/256.5
5,832,765 A * 11/1998 Ohashi ..... B21B 1/18 72/40

FOREIGN PATENT DOCUMENTS

| | | | | |
|---|---|---|---|---|
| JP | 06262236 | A | * | 9/1994 |
| JP | H11-10205 | A | | 1/1999 |
| JP | H11-123483 | A | | 5/1999 |
| JP | 2014076482 | A | * | 5/2014 |
| KR | 20020060647 | A | * | 7/2002 |
| KR | 20060074051 | A | * | 7/2006 |
| KR | 10-2010-011089 | A | | 2/2010 |
| KR | 10-2017-0021503 | A | | 2/2017 |

OTHER PUBLICATIONS

Office Action of Korean Patent Application No. 10-2019-0045464—5 pages (dated Jul. 13, 2020).

* cited by examiner

WIRE ROD ROLLING ROLLER AND GAP ADJUSTMENT DEVICE THEREOF

CROSS-REFERENCE TO RELATED APPLICATIONS

This present application claims benefit of priority to Korean Patent Application Nos. 10-2019-0045463 and 10-2019-0045464 filed on Apr. 18, 2019, in the Korean Intellectual Property Office, the entire disclosures of both of which are incorporated herein by reference.

BACKGROUND

1. Field

The present disclosure relates to a wire rod rolling roller and a gap adjustment device thereof and, specifically, to a wire rod rolling roller and a gap adjustment device thereof, wherein the wire rod rolling roller rotates a worm shaft in a forward and a reverse direction to adjust a gap between rollers, and removes a spark by-product fixed to an inner surface of a forming groove.

2. Description of the Related Technology

Generally, in a manufacturing process of a wire rod, a billet having a cross-sectional area of 160×160 mm is heated at a rollable temperature of 900-1200° C. in a heating furnace to perform a series of rolling processes such as rough rolling intermediate rough rolling, intermediate finishing rolling finishing rolling, and final rolling (sizing rolling). A rolled material described above is finally produced into a wire rod having a diameter of approximately 55-42 mm through a winding process.

SUMMARY

An aspect of the present disclosure is a gap adjustment device, and a wire rod rolling roller including a scraper and the gap adjustment device, by which vertical heights of rollers are precisely adjusted, so that when the rollers may be worn in a wire rod rolling operation or a wire rod having new dimensions is manufactured, a gap between the rollers can be easily adjusted and a spark by-product fixed to an inner surface of a forming groove can be removed.

A wire rod rolling roller of the present disclosure includes: an upper roller and a lower roller spaced a predetermined interval apart from each other and configured to roll a wire rod passing therebetween; an upper drive shaft and a lower drive shaft fixedly extending through the centers of the upper roller and the lower roller, respectively, and configured to rotate the upper roller and the lower roller, an upper bearing housing and a lower bearing housing disposed on one sides of the upper drive shaft and the lower drive shaft, respectively, and configured to support the upper drive shaft and the lower drive shaft; a journal bearing inserted into the upper bearing housing and the lower bearing housing and in surface contact with the upper drive shaft and the lower drive shaft to minimize friction; and a gap adjustment device configured to adjust a gap between the upper roller and the lower roller.

In addition, the gap adjustment device includes: an upper body protruding from a bottom surface of the upper bearing housing and having a through-hole disposed through an outer surface thereof; a lower body protruding from an upper surface of the lower bearing housing and having a through-hole through on an outer surface thereof a worm shaft screw-coupled to inner surfaces of the through-holes formed through the upper body and the lower body, and a worm wheel engaged with an outer surface of the worn shaft, wherein screw directions of internal screws formed on the inner surfaces of the through-holes formed through the upper body and the lower body are formed in opposite directions, a sensor transmitter is disposed on the bottom surface of the upper bearing housing, a sensor receiver is disposed on the upper surface of the lower bearing housing, the sensor receiver is configured to receive a laser beam transmitted from the sensor transmitter to detect a distance between the rollers, and when the detected distance is different from a spacing distance required by a user, a control part is configured to transmit a control signal to a motor to control the number of revolutions of the motor, so as to adjust the distance between the rollers.

In addition, the wire rod rolling roller further includes an anti-loosening device, wherein the anti-loosening device includes: a coupling groove recessed in the outer surface of the lower body; a support bracket which protrudes from the outer surface of the upper body, has a through-hole having an internal screw thread and formed at the center thereof, and has a nut disposed on an upper surface thereof; a fixed bar having a screw thread formed on an outer surface thereof, having an upper portion screw-coupled to the through-hole formed through the support bracket, and having a hinge disposed in a lower portion thereof; and a rotating bar having an upper portion rotatably coupled to the fixed bar by the hinge, and having a coupling protrusion disposed in a lower portion thereof, the coupling protrusion being inserted and fitted into the coupling groove disposed in the lower body, an inclined through-hole is formed through the upper portion of the fixed bar, and an inclined pin is press-fitted into the inclined through-hole.

In addition, the journal bearing is an oil-impregnated bearing which is manufactured by sintering.

In addition, a vertical groove crossing a horizontal groove is formed on an inner surface of the journal bearing to allow a smooth flow of grease throughout the inner surface of the journal bearing, thereby minimizing friction with the drive shafts.

A wire rod rolling roller including a scraper and a gap adjustment device according to the present disclosure includes: an upper roller and a lower roller spaced a predetermined interval apart from each other and configured to roll a wire rod passing therebetween; an upper drive shaft and a lower drive shaft fixedly extending through the centers of the upper roller and the lower roller, respectively, and configured to rotate the upper roller and the lower roller, an upper bearing housing and a lower bearing housing disposed on one sides of the upper drive shaft and the lower drive shaft, respectively, and configured to support the upper drive shaft and the lower drive shaft; a journal bearing inserted into the upper bearing housing and the lower bearing housing and in surface contact with the upper drive shaft and the lower drive shaft to minimize friction, a gap adjustment device configured to adjust a gap between the upper roller and the lower roller, and a scraper, wherein the scraper includes: a shaft support fixed to a predetermined position around the upper and the lower roller and having a through-hole having a screw thread formed on an inner surface thereof, a screw shaft screw-coupled to the through-hole formed through the shaft support a blade disposed at one-side end of the screw shaft in a disk shape or a spherical shape and configured to remove a spark by-product fixed to an inner surface of a forming groove of the rollers; and a handle disposed at the other-side end of the screw shaft.

In addition, the gap adjustment device includes: an upper body protruding from a bottom surface of the upper bearing housing and having a through-hole disposed through an outer surface thereof; a lower body protruding from an upper surface of the lower bearing housing and having a through-hole disposed through an outer surface thereof; a worm shaft screw-coupled to inner surfaces of the through-holes formed through the upper body and the lower body; and a worm wheel engaged with an outer surface of the worm shaft, wherein screw directions of internal screws formed on the inner surfaces of the through-holes formed through the upper body and the lower body are formed in opposite directions, a sensor transmitter is disposed on the bottom surface of the upper bearing housing, a sensor receiver is disposed on the upper surface of the lower bearing housing, the sensor receiver is configured to receive a laser beam transmitted from the sensor transmitter to detect a distance between the rollers, and when the detected distance is different from a spacing distance required by a user, a control part is configured to transmit a control signal to a motor to control the number of revolutions of the motor, so as to adjust the distance between the rollers.

In addition, the wire rod rolling roller further includes an anti-loosening device, wherein the anti-loosening device includes: a coupling groove recessed in the outer surface of the lower body, a support bracket which protrudes from the outer surface of the upper body, has a through-hole having an internal screw thread and formed at the center thereof, and has a nut disposed on an upper surface thereof a fixed bar having a screw thread formed on an outer surface thereof, having an upper portion screw-coupled to the though-hole formed through the support bracket, and having a hinge disposed in a lower portion thereof; and a rotating bar having an upper portion rotatably coupled to the fixed bar by the hinge, and having a coupling protrusion disposed in a lower portion thereof, the coupling protrusion being inserted and fitted into the coupling groove disposed in the lower body, an inclined through-hole is formed through the upper portion of the fixed bar, and an inclined pin is press-fitted into the inclined through-hole.

In addition, the journal bearing is an oil-impregnated bearing which is manufactured by sintering.

In addition, a vertical groove crossing a horizontal groove is formed on an inner surface of the journal bearing to allow a smooth flow of grease throughout the inner surface of the journal beating, thereby minimizing friction with the drive shafts.

According to the present disclosure, since a vertical height adjustment of an upper and a lower r can be precisely made, when the rollers may be worn or a wire rod having new dimensions is manufactured, a gap between the rollers can be easily adjusted.

According to the present disclosure, since a vertical height adjustment of an upper and a lower roller can be precisely made, when the rollers may be worn or a wire rod having new dimensions is manufactured, a gap between the rollers can be easily adjusted and a spark by-product fixed to an inner surface of a forming groove can be removed, so as to improve the quality of a wire rod.

BRIEF DESCRIPTION OF THE DRAWINGS

The above and other aspects, features and advantages of the present disclosure will be more apparent from the following detailed description taken in conjunction with the accompanying drawings.

DETAILED DESCRIPTION

Figure 1:
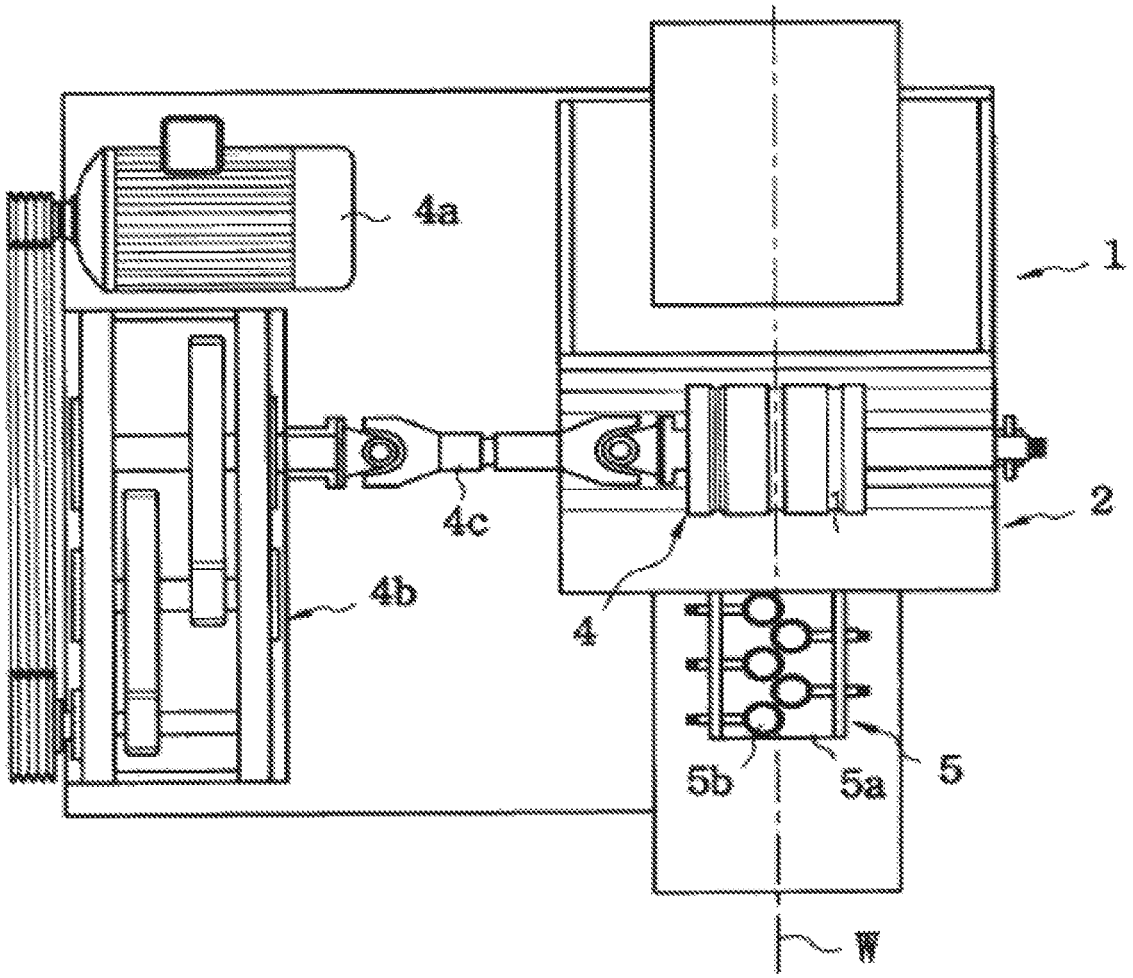
FIG. 1 is a schematic plan view of a wire rod rolling roller.

FIG. 1 is a schematic plan view of a wire rod rolling roller. As shown in FIG. 1, a disclosed guiding device (5) includes: a frame (2) standing and installed on a rolling stand (1); a pair of rolling rollers 4 vertically arranged in the frame 2 so as to rotate while maintaining a predetermined gap, and having a plurality of forming grooves formed in a band shape on an outer circumference thereof; drive devices 4*a*, 4*b*, and 4*c* configured to drive the rolling rollers 4; and guide rollers 5*a* and 5*b* installed at front and rear sides of the rolling rollers 4 to guide entry and exit of a deformed wire rod W.

In such a rolling device, a pair of rolling rollers 4 receive a deformed wire rod W and perform wire-rolling thereof. As a result, the rolling rollers may be worn by repetitive rolling or the gap between the rolling rollers may fail to satisfy requirements by the diameter of a wire rod having new dimensions to be manufactured. In addition, there is a problem that a spark by-product and the like generated from a billet is fixed to an inner surface of a forming groove, a scratch may occur on an outer surface of a manufactured wire rod.

Embodiments of the present disclosure are described in detail with reference to the accompanying drawings. For reference, a size of a component, a thickness of a line, etc. shown in the drawings referred to in describing the present disclosure may be somewhat exaggerated for ease of understanding.

In addition, since terms used in the description of the present disclosure are defined in consideration of functions in the present disclosure, the terms may be changed according to a user, an operator's intention, custom, or the like. Therefore, the definition of the terms should be based on the contents throughout the present specification.

In the present application, it should be understood that the terms "comprise", "have", etc., refer to the presence of a specific number, step, operation, component, part, or a combination thereof described in the specification, and do not exclude in advance the presence of one or more other features, numbers, steps, operations, components, parts, or combinations of thereof, or the possibility of addition.

In addition, the present disclosure is not limited to an embodiment disclosed below, but will be implemented in various different forms, and an embodiment of the present disclosure is provided just to make the description of the present disclosure complete and to fully inform a person skilled in the art about the scope of the disclosure.

Therefore, the present disclosure may be variously modified and may have various forms. Accordingly, aspects (or embodiments) will be described in detail in the specification. However, embodiments are not intended to limit the present disclosure to a specific disclosure form, it should be understood to include all modifications, equivalents, and substitutes which belong to the technical idea of the present disclosure, and a singular expression used in the present specification includes a plural expression unless they are definitely different in the context.

However, in describing the present disclosure, a detailed description of a well-known or publicly known function or configuration is omitted to clarify the gist of the present disclosure.

Hereinafter, example embodiments of the present disclosure are described with reference to the drawings.

Figure 2:
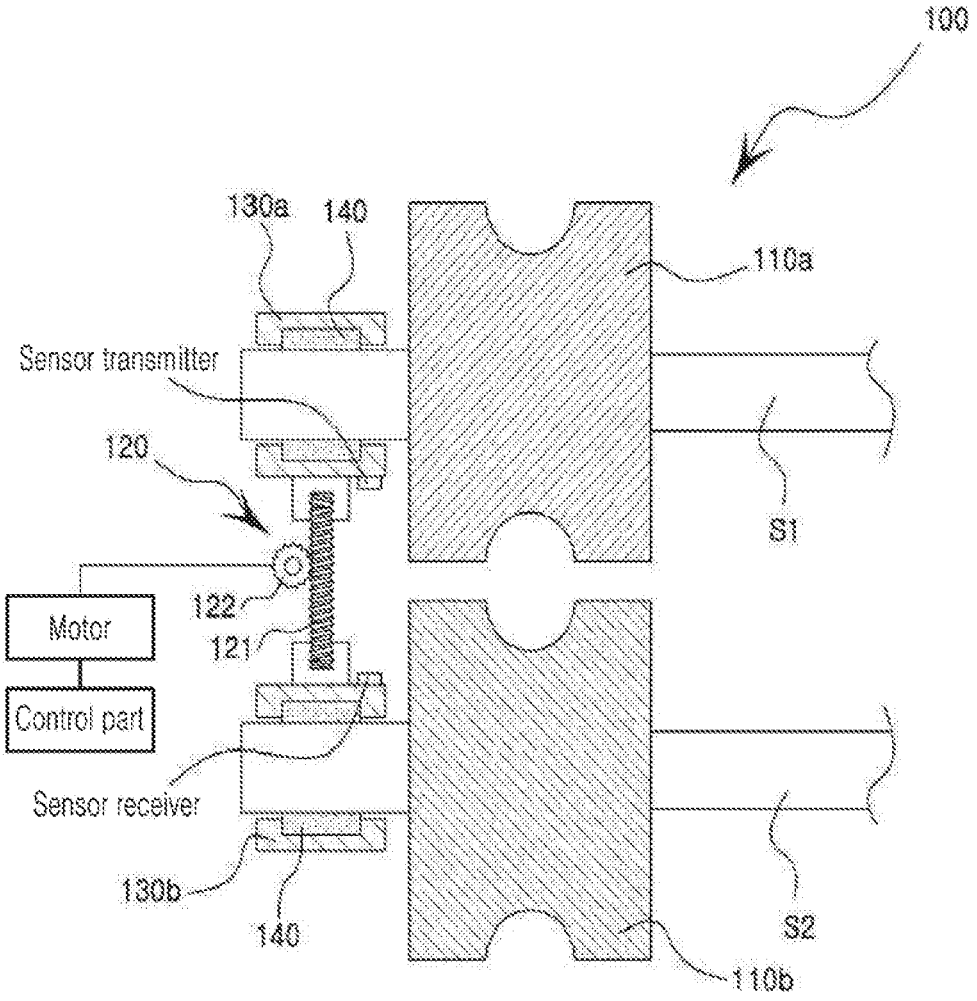
FIG. 2 is a cross-sectional view of an operation state of a gap adjustment device of a wire rod rolling roller of the present disclosure.
Figure 3:
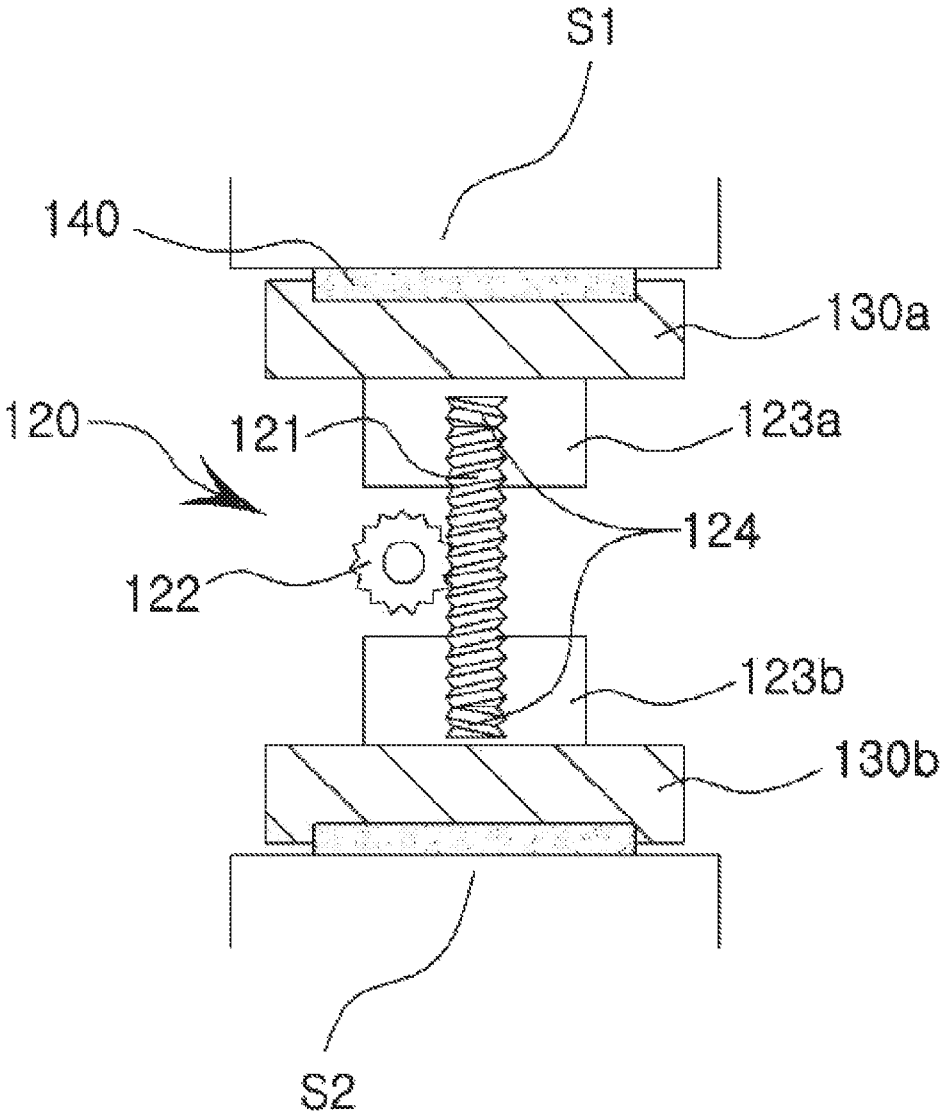
FIG. 3 is an enlarged cross-sectional view of a gap adjustment device.

FIG. 2 is a cross-sectional view of an operation state of a gap adjustment device of a wire rod rolling roller of the present disclosure, and FIG. 3 is an enlarged cross-sectional view of the gap adjustment device.

As shown in FIGS. 2 and 3, the wire rod rolling roller 100 includes an upper and a lower roller 110*a* and 110*b*, an upper and a lower drive shaft S1 and S2, an upper and a lower bearing housing 130*a* and 130*b*, a journal bearing 140, and a gap adjustment device 120.

The upper roller 110*a* and the lower roller 110*b* are spaced a predetermined interval apart from each other, and configured to roll a wire rod passing between the upper roller 110*a* and the lower roller 110*b*.

The upper and the lower drive shaft S1 and S2 are fixedly extending through the centers of the upper and the lower roller 110*a* and 110*b*, and configured to rotate the upper and the lower roller 110*a* and 110*b* while being interlocked with a drive means such as a motor which is not shown.

The upper and the lower bearing housing 130*a* and 130*b* are disposed on one sides of the upper and the lower drive shaft S1 and S2, have the journal bearing 140 embedded therein to be described later, and are configured to support the upper and the lower drive shaft S1 and S2.

A sensor transmitter is disposed on the bottom surface of the upper bearing housing 130*a*, and a sensor receiver is disposed on an upper surface of the lower bearing housing 130*b*. When the sensor transmitter transmits a laser beam, the sensor receiver receives the laser beam to detect a distance between the rollers. When the detected distance is different from a spacing distance required by a user, a control part or controller is configured to transmit a control signal to the motor to control the number of revolutions of the motor, so as to adjust the distance between the rollers.

The journal bearing 140 is inserted into the upper and the lower bearing housing 130*a* and 130*b* and is in surface contact with the upper and the lower drive shaft S1 and S2 to minimize friction.

The gap adjustment device 120, as a characteristic configuration of the present disclosure, includes an upper body 123*a*, a lower body 123*b*, a through-hole 124, a worn shaft 121, and a worm wheel 122.

The upper body 123*a* protrudes from the bottom surface of the upper bearing housing 130*a* and has a through-hole 124 disposed through an outer surface thereof.

The lower body 123*b* protrudes from an upper surface of the lower bearing housing 130*b* and has a through-hole 124 disposed through an outer surface thereof.

Internal screw parts are formed on inner surfaces of the though-holes 124 formed through the upper body 123*a* and the lower body 123*b*. The screw directions of the internal screw formed through the through-hole of the upper body 123*a* and the internal screw formed through the through-hole of the lower body 123*b* are oppositely formed, as in a left-hand screw and a right-hand screw.

The worm shaft 121 is screw-coupled to the inner surfaces of the through-holes 124 formed through the upper body 123*a* and the lower body 123*b*.

The worm wheel 122 is engaged with an outer surface of the worm shaft 121 and is driven by the motor.

The worm wheel is interlocked with the motor.

Hereinafter, the operation relation of such a gap adjustment device is described. When the upper and the lower roller may be worn by repetitive rolling or a wire rod having new dimensions is manufactured, the gap adjustment device 120 is driven to adjust a gap between the rollers, and when the worm wheel 122 is rotated by the motor, the worm shaft 121 engaged with the worm wheel is rotated. When the worm shaft is rotated, the worm shaft pulls or pushes the upper and the lower body 123*a* and 123*b* by internal screws formed in the through-holes of the upper and the lower body in opposite directions, so as to adjust a gap between the upper and the lower drive shaft S1 and S2. As a result, a gap between the upper and the lower roller 110*a* and 110*b*, which are coupled to the upper and the lower drive shaft, is adjusted.

Since a vertical height adjustment of the upper and the lower rolling roller can be precisely made by the above-described gap adjustment device, when the rollers may be worn or a wire rod having new dimensions is manufactured, a gap between the rollers can be easily adjusted.

Hereinafter, an anti-loosening device, as a second embodiment of the present disclosure, is described.

Since the worm shaft 121 of the gap adjustment device as described above is screw-coupled to the internal screw parts formed in the through-holes 124 of the upper and the lower body, a loosening phenomenon may occur in which the worm shaft 121 is loosened from the internal screw parts due to vibration generated by continuous driving of the rollers and thus a gap between the upper and the lower roller is changed. Therefore, an embodiment of the present disclosure proposes the anti-loosening device configured to prevent the worm shaft from loosening from the internal screws.

Figure 4:
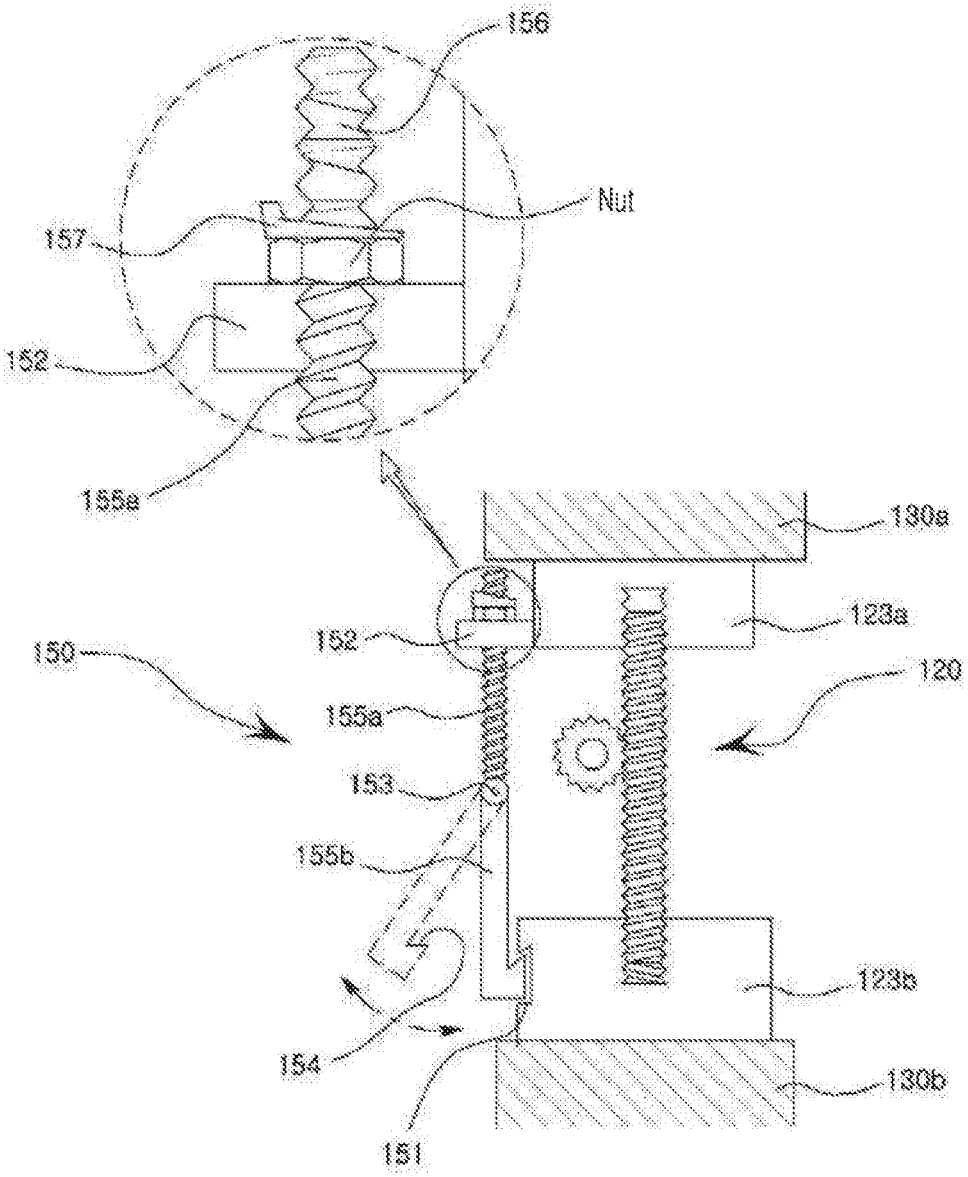
FIG. 4 is a front view and a partially enlarged view of an anti-loosening device.

FIG. 4 is a front view and a partially enlarged view of the anti-loosening device according to an embodiment of the present disclosure.

As shown in FIG. 4, the anti-loosening device 150 includes a coupling groove 151, a support bracket 152, a hinge 153, a fixed bar 155*a*, a rotating bar 155*b*, and an inclined pin 157.

The coupling groove 151 is recessed in an outer surface of the lower body 123*b*.

The support bracket 152 protrudes from an outer surface of the upper body 123*a*, has a through-hole having an internal screw thread and formed at the center thereof, and has a nut disposed on an upper surface thereof.

The fixed bar 155*a* has a screw thread formed on an outer surface thereof, has an upper portion screw-coupled to the through-hole formed through the support bracket 152, and has a hinge 153 disposed in a lower portion thereof to be rotatably coupled to the rotating bar 155*b* described later.

A plurality of inclined through-holes 156 are formed in an upper portion of the fixed bar 155*a* in up and down directions.

The rotating bar 155*b* has an upper portion rotatably coupled to the fixed bar 155*a* by the hinge 153 and has a coupling protrusion 154 in a lower portion thereof and the coupling protrusion 154 is selectively inserted and fitted into the coupling groove 151 disposed in the lower body 123*b*.

The inclined pin 157 is inserted and fixed in the form of a press-fit to the inclined through-holes 156 formed in the upper portion of the fixed bar 155*a*.

Hereinafter, the operation relation of such an anti-loosening device 150 is described. The gap adjustment device

120 adjusts a gap between the upper and the lower roller, and then rotates the rotating bar 155*b* to insert the coupling protrusion 154 into the coupling groove 151. Then, the nut disposed in an upper end portion of the fixed bar 155*a*, which is screw-coupled to the through-hole of the support bracket 152, is rotated by using a tool to firmly fix a gap between the support bracket 152 and the lower body 123*b*. Then, the inclined pin 157 is hit to be inserted into the inclined through-hole 156 formed on an upper end of the fixed bar 155*a*, so that a gap between the support bracket and the lower body is firmly fixed to be maintained at a predetermined interval. Therefore, a screw loosening phenomenon of the gap adjustment device can be fundamentally prevented.

Hereinafter, the journal bearing, as a second embodiment of the present disclosure, is described.

The journal bearing 140 according to an embodiment of the present disclosure is a containing bearing manufactured by sintering. In relation to such a journal bearing 140, according to a relative rotation with a shaft to be supported, grease impregnated in the journal bearing exudes from a sliding surface in contact with the shaft to form a lubricating film, and the shaft is rotated and supported by the lubricating film, so that the journal bearing 140 has high bearing performance and durability.

Figure 5:
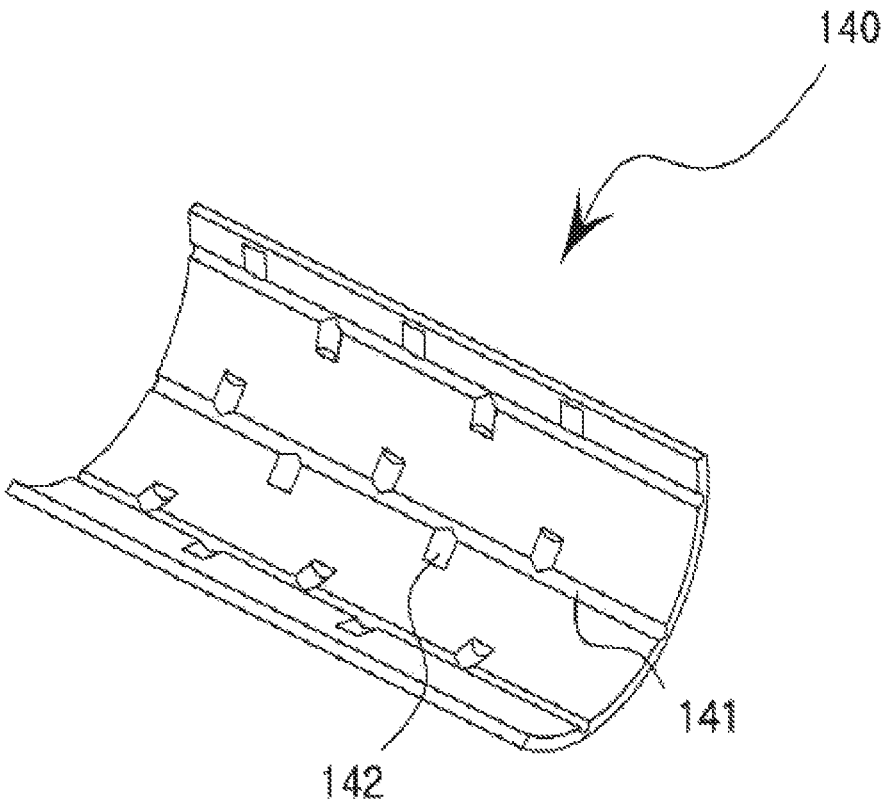
FIG. 5 is a partial cutaway perspective view of a journal bearing.

FIG. 5 is a partial cutaway perspective view of the journal bearing.

As shown in FIG. 5, a vertical groove 142 crossing a horizontal groove 141 is formed on an inner surface of the journal bearing 140 to allow a smooth flow of grease throughout the inner surface of the journal bearing, thereby minimizing fiction with the shaft.

The journal bearing 140 has a porosity of 15 to 30% and is impregnated with grease having a worked penetration of 400 to 475 in a pore, and a base portion excluding the pore is formed of 5 to 15 parts by weight of at least one of Sn, Zn, Ni, and P with respect to 100 parts by weight of Cu.

The journal bearing 140 as described above has excellent lubricity and wear resistance, and has a high lubricating film strength which prevents a metal contact between the bearing and the shaft even under a high surface pressure condition. In addition, even in a low speed condition, the grease impregnated in the bearing can be sufficiently supplied to the sliding surface.

Hereinafter, a structure of a scraper is described.

Figure 6:
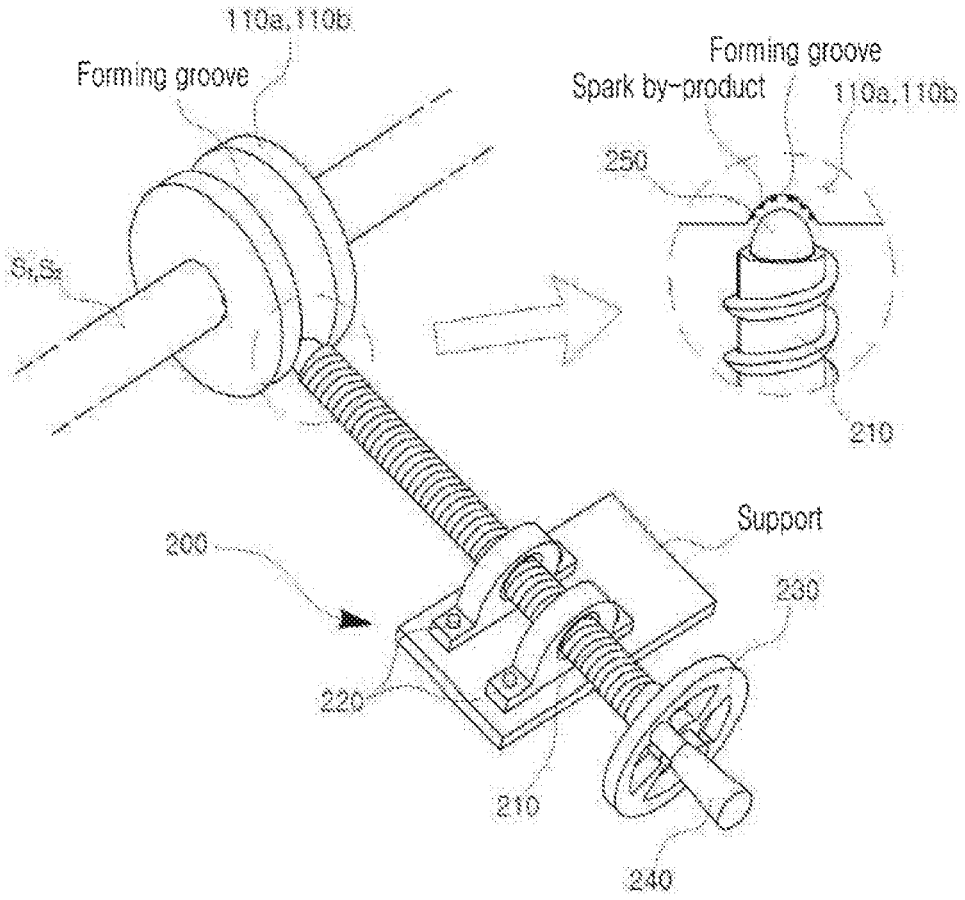
FIG. 6 is a perspective view and a partially enlarged view of a scraper.

FIG. 6 is a perspective view and a partially enlarged view of the scraper.

As shown in FIG. 6, the scraper 200 includes a screw shaft 210, a shaft support 220, a handle 230, an auxiliary handle 240, and a blade 250.

The shaft support 220 is coupled through a bolt or the like to an upper surface of a support fixed to a predetermined position around the upper and the lower roller, has a through-hole formed in the center portion thereof, the through-hole having a screw thread formed on an inner surface thereof, and is thus coupled to the screw shaft 210.

The screw shaft 210 is screw-coupled to the through-hole formed through the shaft support 220.

The blade 250 is disposed at one-side end of the screw shaft 210 in a disk shape or a spherical shape, and is configured to remove a spark by-product fixed to an inner surface of a forming groove of the rollers 110*a* and 110*b*.

The handle 230 is disposed at the other-side end of the screw shaft 210, and is configured to allow a user to rotate the handle to move the screw shaft 210 and thus allow the blade 250 disposed at the one-side end of the screw shaft 210 to enter the inside of the forming groove.

The auxiliary handle 240 is configured to enable an easy grip of a user and thus quickly rotate the handle.

Hereinafter, the operation relation of such a scraper is described. When a user recognizes that a scratch occurs on the surface of a wire rod which is rolled out, the user stops the operation of the rollers and rotates the handle.

When the handle is rotated, the screw shaft is moved straight by the screw thread formed on the inner surface of the through-hole of the shaft support.

When the screw shaft is moved and thus the blade disposed at the one-side end of the screw shaft comes into contact with the inner surface of the forming groove of the rollers, the rollers are idled to remove a spark by-product fixed to the inside of the forming groove, the handle is reverse-rotated to remove the blade inside the forming groove, and then rolling is performed again, so that the quality of a rolled wire rod can be improved.

The present disclosure described as above is not limited by the aspects described herein and the accompanying drawings. It should be apparent to those skilled in the art that various substitutions, changes and modifications which are not exemplified herein but are still within the spirit and scope of the present disclosure may be made. Therefore, the scope of the present disclosure is defined not by the detailed description, but by the claims and their equivalents, and all variations within the scope of the claims and their equivalents are to be construed as being included in the present disclosure.

What is claimed is:

1. A wire rod rolling roller comprising:

an upper roller and a lower roller spaced a predetermined interval apart from each other and configured to roll a wire rod passing therebetween;

an upper drive shaft and a lower drive shaft fixedly extending through centers of the upper roller and the lower roller, respectively, and configured to rotate the upper roller and the lower roller;

an upper bearing housing and a lower bearing housing respectively disposed on one side of the upper drive shaft and one side of the lower drive shaft, and configured to support the upper drive shaft and the lower drive shaft;

a first journal bearing inserted into the upper bearing housing and in surface contact with the upper drive shaft to minimize friction and a second journal bearing inserted into the lower bearing housing and in surface contact with the lower drive shaft to minimize friction; and a gap adjustment device configured to adjust a gap between the upper roller and the lower roller, wherein the gap adjustment device comprises:

an upper body protruding from a bottom surface of the upper bearing housing and having a hole disposed in an outer surface thereof;

a lower body protruding from an upper surface of the lower bearing housing and having a hole disposed in an outer surface thereof;

a worm shaft screw-coupled to inner surfaces of the holes formed in the upper body and the lower body, wherein screw directions of internal screws formed on the inner surfaces of the holes are formed in opposite directions;

a worm wheel engaged with an outer surface of the worm shaft;

a sensor transmitter disposed on the bottom surface of the upper bearing housing;

a sensor receiver disposed on the upper surface of the lower bearing housing and configured to receive a laser beam transmitted from the sensor transmitter to detect a distance between the upper and lower rollers; and a controller configured to transmit a control signal to a motor to control the number of revolutions of the motor, so as to adjust the distance between the upper and lower rollers in response to the detected distance being different from the predetermined interval.

2. The wire rod rolling roller of claim 1, further comprising an anti-loosening device, wherein the anti-loosening device comprises:

a coupling groove recessed in the outer surface of the lower body;

a support bracket protruding from the outer surface of the upper body, having a through-hole having an internal screw thread and formed at the center thereof, and having a nut disposed on an upper surface thereof;

a fixed bar having a screw thread formed on an outer surface thereof, having an upper portion screw-coupled to the through-hole formed through the support bracket, and having a hinge disposed in a lower portion thereof;

a rotating bar having an upper portion rotatably coupled to the fixed bar by the hinge, and having a coupling protrusion disposed in a lower portion thereof, the coupling protrusion being inserted and fitted into the coupling groove disposed in the lower body;

an inclined through-hole formed through the upper portion of the fixed bar; and an inclined pin press-fitted into the inclined through-hole.

3. The wire rod rolling roller of claim 2, wherein the first and second journal bearings are oil-impregnated bearings manufactured by sintering.

4. The wire rod rolling roller of claim 3, wherein a vertical groove crossing a horizontal groove is formed on an inner surface of the first and second journal bearings to allow a smooth flow of grease throughout the inner surface of the first and second journal bearings, thereby minimizing friction with the upper and lower drive shafts.

5. A wire rod rolling roller comprising:

an upper roller and a lower roller spaced a predetermined interval apart from each other and configured to roll a wire rod passing therebetween;

an upper drive shaft and a lower drive shaft fixedly extending through centers of the upper roller and the lower roller, respectively, and configured to rotate the upper roller and the lower roller;

an upper bearing housing and a lower bearing housing respectively disposed on one side of the upper drive shaft and one side of the lower drive shaft, and configured to support the upper drive shaft and the lower drive shaft;

a first journal bearing inserted into the upper bearing housing and in surface contact with the upper drive shaft to minimize friction and a second journal bearing inserted into the lower bearing housing and in surface contact with the lower drive shaft to minimize friction;

a gap adjustment device configured to adjust a gap between the upper roller and the lower roller; and a scraper, wherein the scraper comprises:

a shaft support fixed to a predetermined position around the upper roller and the lower roller and having a through-hole having a screw thread formed on an inner surface thereof;

a screw shaft screw-coupled to the through-hole formed through the shaft support;

a blade disposed at one-side end of the screw shaft in a spherical shape and configured to remove a spark by-product fixed to an inner surface of the upper and lower rollers; and a handle disposed at the other-side end of the screw shaft, wherein the gap adjustment device comprises:

an upper body protruding from a bottom surface of the upper bearing housing and having a hole disposed in an outer surface thereof;

a lower body protruding from an upper surface of the lower bearing housing and having a hole disposed in an outer surface thereof;

a worm shaft screw-coupled to inner surfaces of the holes formed in the upper body and the lower body, wherein screw directions of internal screws formed on the inner surfaces of the holes are formed in opposite directions;

a worm wheel engaged with an outer surface of the worm shaft;

a sensor transmitter disposed on the bottom surface of the upper bearing housing;

a sensor receiver disposed on the upper surface of the lower bearing housing and configured to receive a laser beam transmitted from the sensor transmitter to detect a distance between the upper and lower rollers; and a controller configured to transmit a control signal to a motor to control the number of revolutions of the motor, so as to adjust the distance between the upper and lower rollers in response to the detected distance being different from the predetermined interval.

6. The wire rod rolling roller of claim 5, further comprising an anti-loosening device, wherein the anti-loosening device comprises:

a coupling groove recessed in the outer surface of the lower body;

a support bracket which protrudes from the outer surface of the upper body, has a through-hole having an internal screw thread and formed at the center thereof, and has a nut disposed on an upper surface thereof;

a fixed bar having a screw thread formed on an outer surface thereof, having an upper portion screw-coupled to the through-hole formed through the support bracket, and having a hinge disposed in a lower portion thereof;

a rotating bar having an upper portion rotatably coupled to the fixed bar by the hinge, and having a coupling protrusion disposed in a lower portion thereof, the coupling protrusion being inserted and fitted into the coupling groove disposed in the lower body;

an inclined through-hole formed through the upper portion of the fixed bar; and an inclined pin press-fitted into the inclined through-hole.

7. The wire rod rolling roller of claim 6, wherein the first and second journal bearings are oil-impregnated bearings manufactured by sintering.

8. The wire rod rolling roller of claim 7, wherein a vertical groove crossing a horizontal groove is formed on an inner surface of the first and second journal bearings to allow a smooth flow of grease throughout the inner surface of the first and second journal bearings, thereby minimizing friction with the upper and lower drive shafts.

* * * * *